US008157260B2

(12) United States Patent
Tsai et al.

(10) Patent No.: US 8,157,260 B2
(45) Date of Patent: Apr. 17, 2012

(54) ROLLER MODULE FOR AN AUTOMATIC DOCUMENT FEEDER

(75) Inventors: Chen-Tsai Tsai, Taipei (TW); Hsueh-Chou Hsu, Taipei (TW); Chia-Chun Li, Taipei (TW)

(73) Assignees: Silitek Electronic (Guangzhou) Co., Ltd., Guangzhou (CN); Lite-On Technology Corp., Taipei (TW)

( * ) Notice: Subject to any disclaimer, the term of this patent is extended or adjusted under 35 U.S.C. 154(b) by 503 days.

(21) Appl. No.: 12/289,626

(22) Filed: Oct. 31, 2008

(65) Prior Publication Data

US 2009/0250868 A1 Oct. 8, 2009

(30) Foreign Application Priority Data

Apr. 4, 2008 (CN) ..... 2008 1 0027246

(51) Int. Cl.
*B65H 7/02* (2006.01)

(52) U.S. Cl. .... 271/228; 281/225; 281/242; 281/258.03

(58) Field of Classification Search ..... 271/258.03, 271/258.05, 225, 228, 242
See application file for complete search history.

(56) References Cited

U.S. PATENT DOCUMENTS

| | | | | |
|---|---|---|---|---|
| 5,611,277 | A * | 3/1997 | Bayer et al. | 271/277 |
| 6,079,708 | A | 6/2000 | Fujita | |
| 6,641,130 | B2 * | 11/2003 | Lee et al. | 271/242 |
| 6,672,581 | B2 * | 1/2004 | Lee et al. | 271/242 |
| 6,786,480 | B2 * | 9/2004 | Lee et al. | 271/242 |
| 2006/0012104 | A1 | 1/2006 | Kim | |

* cited by examiner

*Primary Examiner* — Gerald McClain
(74) *Attorney, Agent, or Firm* — Rosenberg, Klein & Lee

(57) ABSTRACT

A roller module is adapted for use with an automatic document feeder, and is adapted for feeding of a document sheet therethrough. The roller module comprises a first roller, a second roller disposed adjacent to and parallel to the first roller and cooperating with the first roller to define a nip, a driven component co-rotatable with the first roller, and a driving component rotatable for abutting against and driving the driven component to rotate, thereby permitting feeding of the document sheet through the nip. During rotation of the driving component, the document sheet is brought into contact with the first and second rollers for a predetermined time period to perform skew correction before the driving component rotates the driven component.

5 Claims, 10 Drawing Sheets

ROLLER MODULE FOR AN AUTOMATIC DOCUMENT FEEDER

CROSS-REFERENCE TO RELATED APPLICATION

This application claims priority of Chinese Application No. 200810027246.2, filed on Apr. 4, 2008.

BACKGROUND OF THE INVENTION

1. Field of the Invention

The invention relates to a roller module, more particularly to a roller module for an automatic document feeder.

2. Description of the Related Art

U.S. Patent Application Publication No. 2006/0012104 A1 discloses an automatic document feeder as illustrated in FIG. 1. In use, a document sheet is inserted into the automatic document feeder by a first pick up roller 120 and is fed to a feed roller unit 130 through a dispensing roller 122 and a first roller unit 128. Afterward, the document sheet is conveyed from the feed roller unit 130 to a discharge roller unit 132 through an image scanning device 102, while a side of the document sheet is scanned. The document sheet can be reinserted into the automatic document feeder by a second pick up roller 140, and be fed to the feed roller unit 130 via an intermediate roller unit 142 for passing through the image scanning device 102 once again, such that an opposite side of the document sheet can be scanned. Since the feeding speeds of the first roller unit 128 and the intermediate roller unit 142 are both slightly faster than the feeding speed of the feed roller unit 130, tensile stress of the document sheet can be eliminated during the movement of the document sheet from either one of the first roller unit 128 and the intermediate roller unit 142 to the feed roller unit 130, such that skew of the document sheet can be corrected before the document sheet is advanced through the feed roller unit 130.

However, if the speed difference between the feed roller unit 130 and either one of the first roller unit 128 and the intermediate roller unit 142 is too large, the document sheet will deform seriously between the feed roller unit 130 and either one of the first roller unit 128 and the intermediate roller unit 142, which may result in a poor image scanning quality or even cause jamming of the document sheet. On the contrary, if the speed difference between either one of the first roller unit 128 and the intermediate roller unit 142 and the feed roller unit 130 is too small, the skew correcting effect of the automatic document feeder will be adversely affected.

U.S. Pat. No. 6,079,708 discloses a conventional roller module for an automatic document feeder as illustrated in FIG. 2. The conventional roller module includes a pair of parallel rollers 15, 16 that are adjacent to each other, and a skew correction film 17 that is made from an elastic material and that is disposed upstream of the rollers 15, 16. During movement of a document sheet 18 through the conventional roller module, a leading part of the document sheet 18 contacts and is slowed down by the skew correction film 17 before the document sheet 18 is fed through the rollers 15, 16. Since the remaining part of the document sheet 18 is still being fed toward the conventional roller module at that time, skew of the document sheet 18 can be corrected.

However, the skew correcting effect may vary according to qualities of the document sheet 18. Moreover, it is difficult to find the most suitable material for the skew correction film 17.

SUMMARY OF THE INVENTION

Therefore, an object of the present invention is to provide a roller module for an automatic document feeder that is capable of performing skew correction of a document sheet, and that can overcome the aforesaid drawbacks associated with the prior art.

Another object of the present invention is to provide an automatic document feeder having a roller module that is capable of performing skew correction of a document sheet, and that can overcome the aforesaid drawbacks associated with the prior art.

Accordingly, a roller module of the present invention is adapted for use with an automatic document feeder, and is adapted for feeding of a document sheet therethrough. The roller module comprises a first roller, a second roller disposed adjacent to and parallel to the first roller and cooperating with the first roller to define a nip, a driven component co-rotatable with the first roller, and a driving component rotatable for abutting against and driving the driven component to rotate, thereby permitting feeding of the document sheet through the nip. During rotation of the driving component, the document sheet is brought into contact with the first and second rollers for a predetermined time period to perform skew correction before the driving component rotates the driven component.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
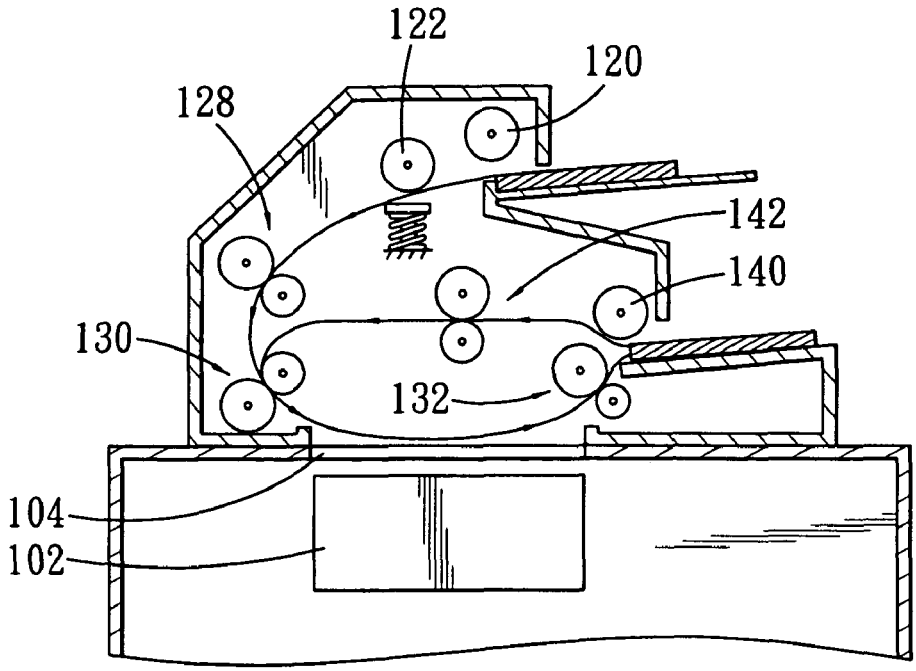
FIG. 1 PRIOR ART
FIG. 1 is a fragmentary schematic sectional view of a conventional automatic document feeder disclosed in U.S. Patent Application Publication No. 2006/0012104 A1.
Figure 2:
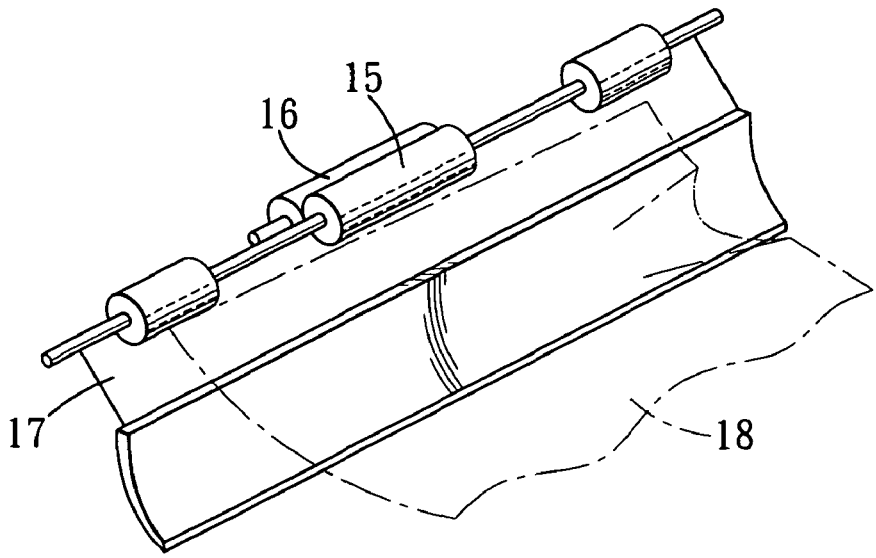
FIG. 2 PRIOR ART
FIG. 2 is a perspective view of a conventional roller module disclosed in U.S. Pat. No. 6,079,708.

Before the present invention is described in greater detail, it should be noted that like elements are denoted by the same reference numerals throughout the disclosure.

Figure 3:
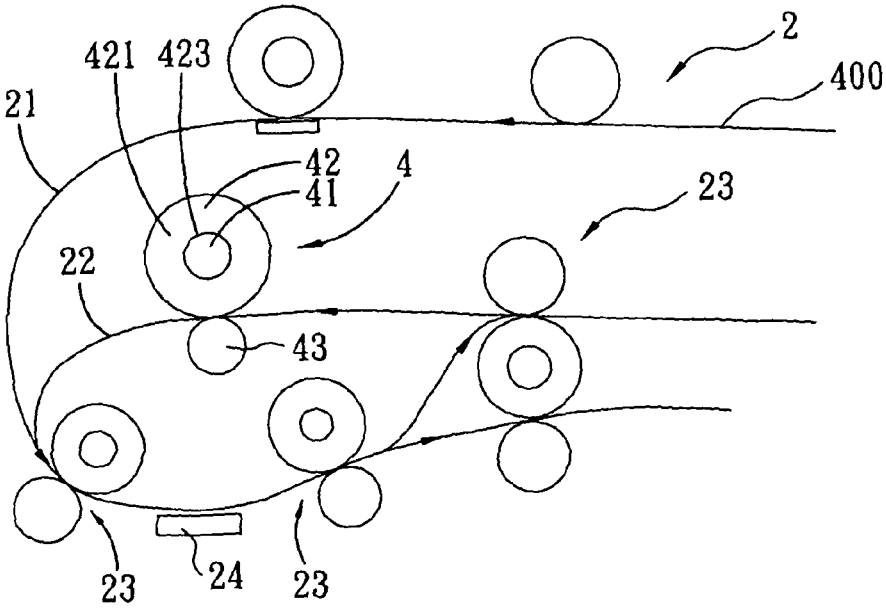
FIG. 3 is a schematic side view of a first preferred embodiment of an automatic document feeder according to the invention.
Figure 4:
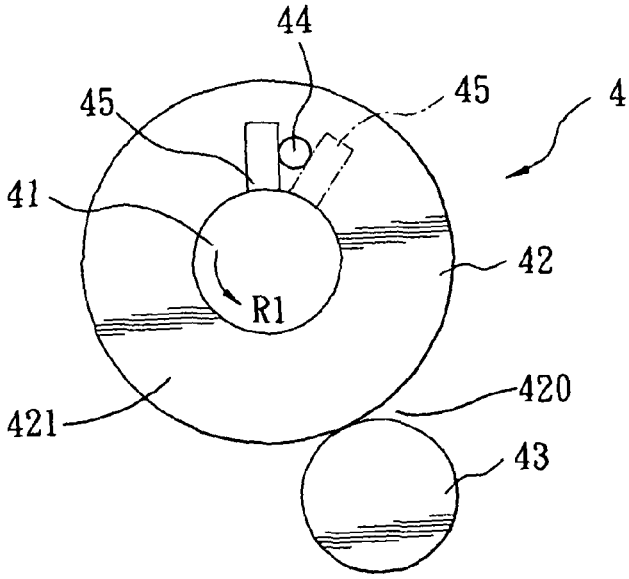
FIG. 4 is a side view of a roller module of the first preferred embodiment, illustrating a driving component that contacts a side of a driven component.
Figure 5:
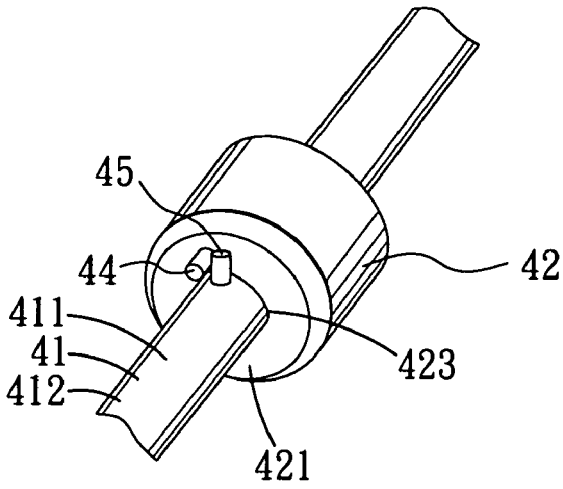
FIG. 5 is a fragmentary perspective view of the roller module of the first preferred embodiment.

As shown in FIGS. 3 to 5, the first preferred embodiment of an automatic document feeder 2 according to the present invention is adapted for feeding a document sheet 400, and comprises a housing (not shown), a plurality of roller units 23 disposed in the housing, an image scanning unit 24 disposed in the housing, and a roller module 4 disposed in the housing and spaced apart from the image scanning unit 24. In this embodiment, the document sheet 400 fed into the automatic document feeder 2 is initially conveyed onto the roller module 4 via a first conveying route 21, such that a side thereof can be scanned by the image scanning unit 24. Afterward, the document sheet 400 is flipped over, and is conveyed onto the roller module 4 once again via a second conveying route 22, such that an opposite side thereof can be scanned by the image scanning unit 24.

The roller module 4 includes a transmission shaft 41, a first roller 42, a second roller 43, a driven component 44, and a driving component 45. The first roller 42 has axially opposite first and second end surfaces 421, 422 (see FIG. 7) and a shaft hole 423 extending axially from the first end surface 421 to the second end surface 422. The second roller 43 is disposed adjacent to and parallel to the first roller 42, and cooperates with the first roller 42 to define a nip 420. In this embodiment, the transmission shaft 41 is disposed rotatably in the shaft hole 423, and has an annular surrounding surface 411 and an end portion 412 exposed from the first end surface 421 of the first roller 42. In this embodiment, the driven component 44 is a rod projecting axially from the first end surface 421 of the first roller 42, and is co-rotatable with the first roller 42. The driving component 45 is a rod disposed fixedly on the end portion 412 of the transmission shaft 41 and projecting radially from the annular surrounding surface 411 of the transmission shaft 41, and is rotatable for abutting against and driving the driven component 44 to rotate, thereby permitting feeding of the document sheet 400 through the nip 420.

Figure 6:
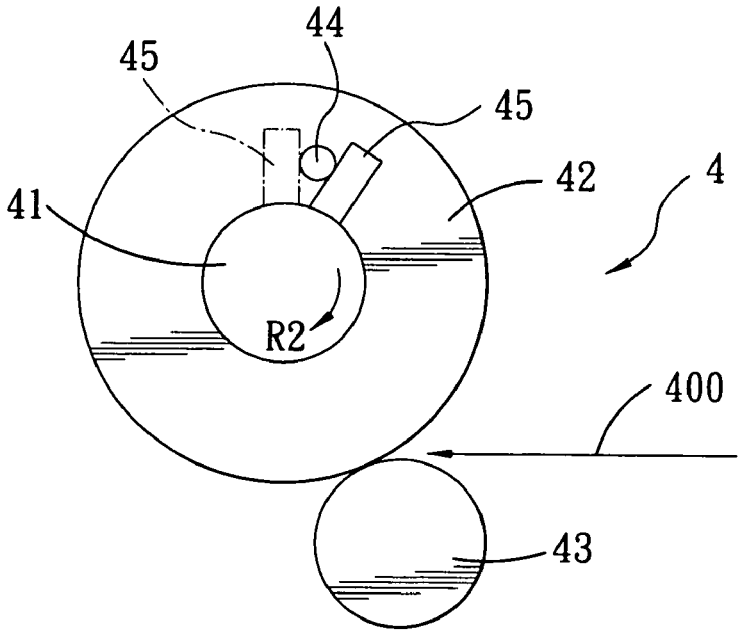
FIG. 6 is a view similar to FIG. 4, but illustrating the driving component that contacts an opposite side of the driven component.

Referring to FIGS. 3 and 4, during the movement of the document sheet 400 along the first conveying route 21, the transmission shaft 41 is actuated to rotate along with the driving component 45 in a first direction (R1) until the driving component 45 contacts a side of the driven component 44. Afterward, as shown in FIGS. 3 and 6, during the movement of the document sheet 400 along the second conveying route 22, the transmission shaft 41 is further actuated to rotate reversely along with the driving component 45 in a second direction (R2) opposite to the first direction (R1), such that the driving component 45 abuts against an opposite side of the driven component 44 and drives the driven component 44 to rotate in the second direction (R2) along with the first roller 42, thereby permitting feeding of the document sheet 400 through the nip 420. In this embodiment, the first roller 42 is rotatable in only a single direction, that is, the second direction (R2).

Figure 7:
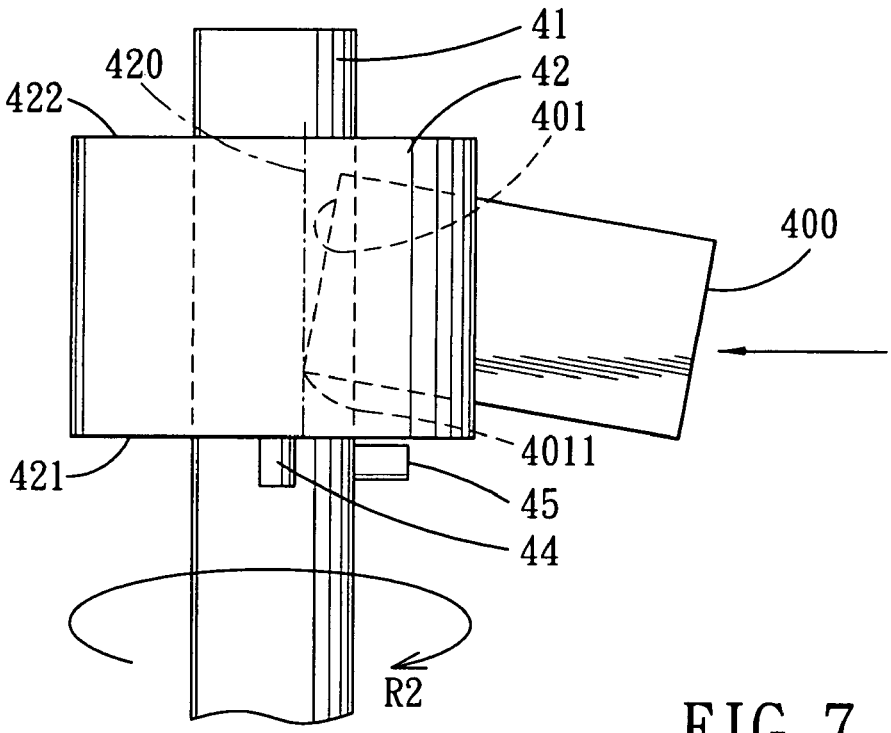
FIG. 7 is a fragmentary top view of the roller module of the first preferred embodiment before document skew is corrected.
Figure 8:
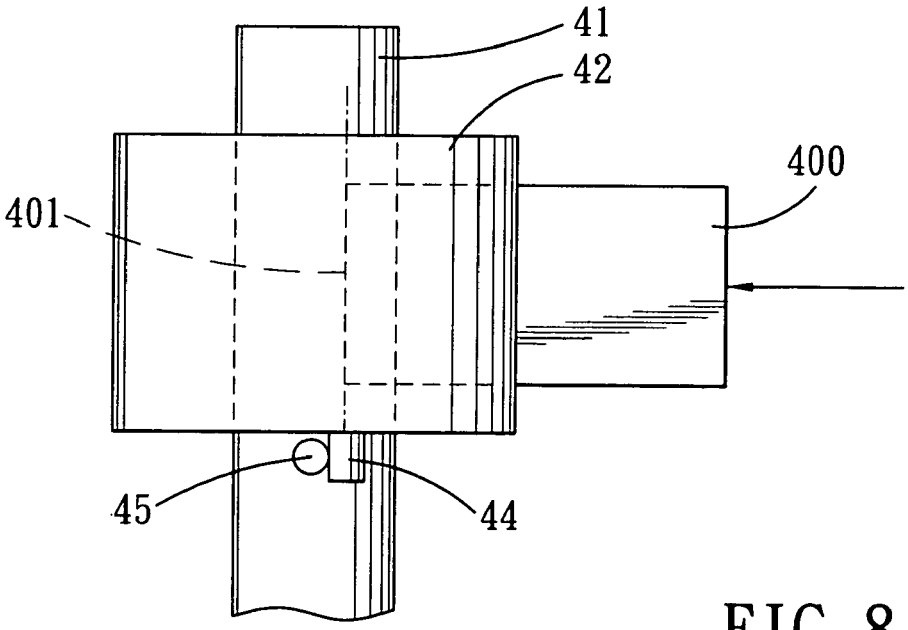
FIG. 8 is another fragmentary top view of the roller module of the first preferred embodiment after document skew is corrected.

As shown in FIGS. 6 to 8, when the transmission shaft 41 rotates in the second direction (R2), and before the driving component 45 abuts against the driven component 44, once a leading edge 401 of the document sheet 400 is conveyed in a skewed manner, a corner 4011 of the leading edge 401 of the document sheet 400 will contact the first and second rollers 42, 43 earlier than the remaining portion of the leading edge 401 of the document sheet 400 (see FIG. 7). At that time, since the driving component 45does not push the driven component 44, the first roller 42 cannot rotate, thereby preventing the document sheet 400 from being fed through the nip 420. Afterward, as conveying of the document sheet 400 is not interrupted, the portion of the leading edge 401 of the document sheet 400 other than the corner 4011 contacts the first and second rollers 42, 43, thereby correcting the skew of the document sheet 400 (see FIG. 8). Finally, the driving component 45 drives the driven component 44 and the first roller 42 to rotate, so that the document sheet 400 is permitted to be fed through the nip 420. Therefore, during rotation of the driving component 45 in the second direction (R2), the document sheet 400 is brought into contact with the first and second rollers 42, 43 for a predetermined time period to perform skew correction before the driving component 45 rotates the driven component 44.

In this embodiment, since skew correction is not performed via a difference between feeding speeds of the roller units 23 and the roller module 4, the drawbacks of the aforementioned conventional automatic document feeder of U.S. Patent Application Publication No. 2006/0012104 A1 can be overcome. Moreover, the roller module 4 is suitable for feeding document sheets of different sizes and qualities, thereby resulting in a relatively high flexibility during use.

It should be noted that the rotational speed of the transmission shaft 41 may vary in other embodiments of this invention so as to fit the document sheets 400 of different feeding speeds or sizes.

Figure 9:
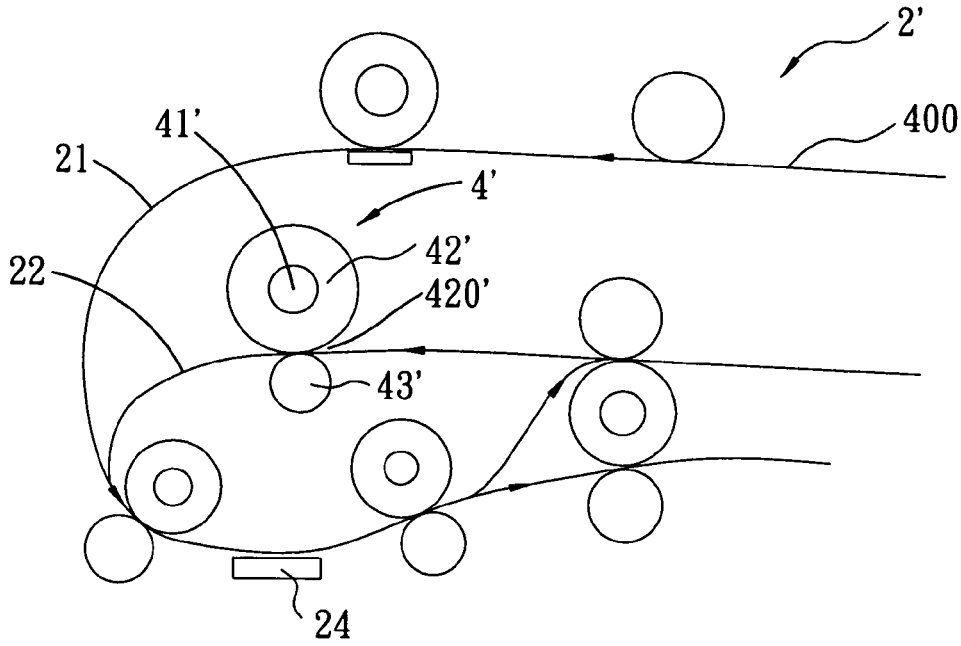
FIG. 9 is a schematic side view of a second preferred embodiment of the automatic document feeder according to the invention.
Figure 10:
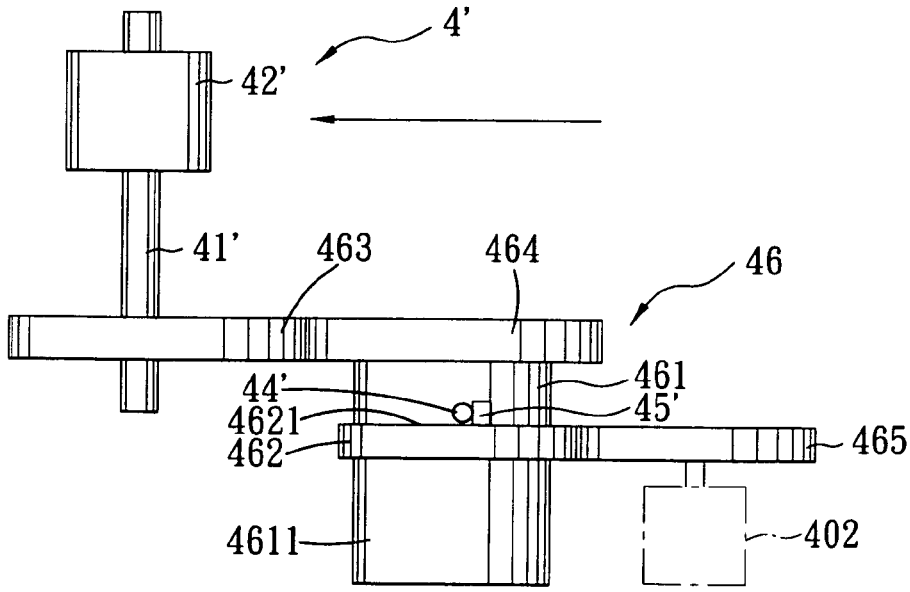
FIGS. 10 and 11 are respectively schematic top and side views of a roller module and a transmission mechanism of the second preferred embodiment, illustrating a driving component contacting a side of a driven component.
Figure 11:
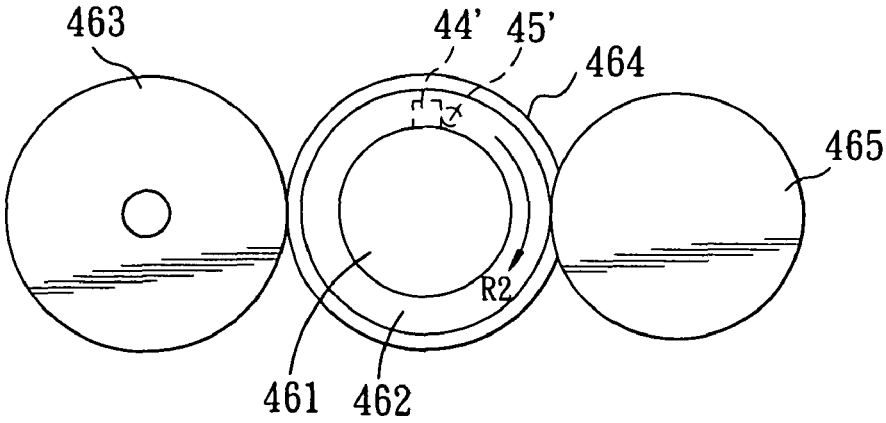

As shown in FIGS. 9 to 11, the second preferred embodiment of the automatic document feeder 2' according to the present invention includes a roller module 4' that has a structure similar to that 2 of the first preferred embodiment, and a transmission mechanism 46. The roller module 4' includes a transmission shaft 41', a first roller 42', a second roller 43', a driven component 44', and a driving component 45'. The transmission shaft 41' is connected coaxially and fixedly to the first roller 42'. The second roller 43' is disposed adjacent to and parallel to the first roller 42', and cooperates with the first roller 42' to define a nip 420'. The transmission mechanism 46 includes a first transmission member 461 having an annular outer surface 4611 on which the driven component 44' of the roller module 4' is fixedly disposed, and a second transmission member 462 sleeved rotatably on the first transmission member 461 and having an annular side surface 4621 that confronts the driven component 44'. In this embodiment, the second transmission member 462 is a gear. The transmission mechanism 46 further includes a first gear 463 connected fixedly to the transmission shaft 41' of the roller module 4', a second gear 464 connected fixedly to the first transmission member 461 and meshing with the first gear 463, and a third gear 465 connected to a power source 402 and meshing with the second transmission member 462. In this embodiment, the driven component 44' of the roller module 4' is a rod projecting radially from the annular outer surface 4611 of the first transmission member 461 of the transmission mechanism 46, and the driving component 45' is a rod projecting axially from the annular side surface 4621 of the second transmission member 462.

Figure 12:
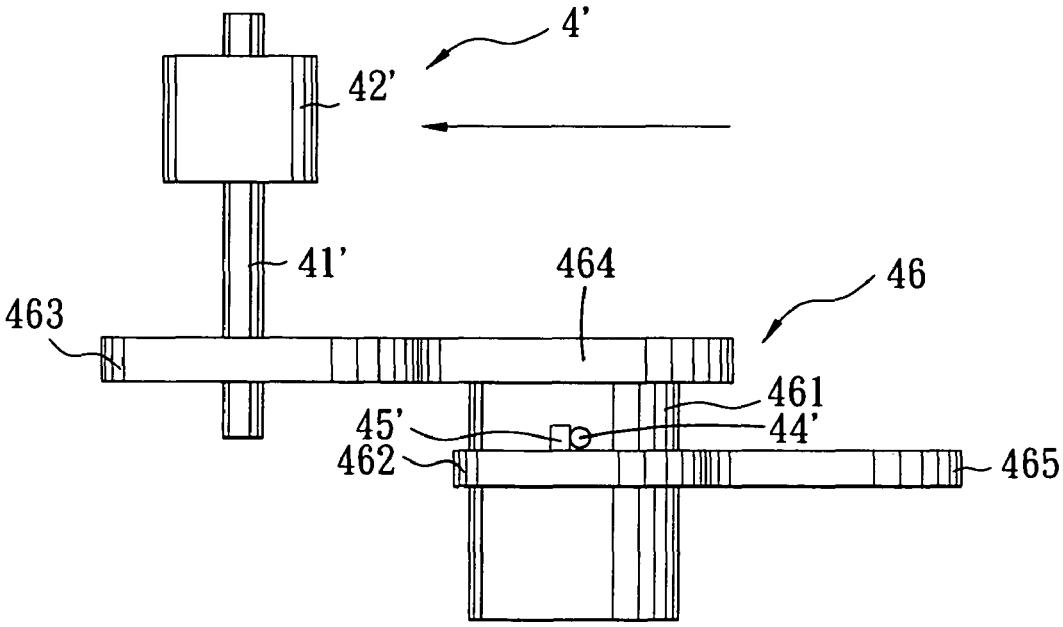
FIGS. 12 and 13 are views similar to FIGS. 10 and 11, respectively, but illustrating the driving component contacting an opposite side of the driven component.
Figure 13:
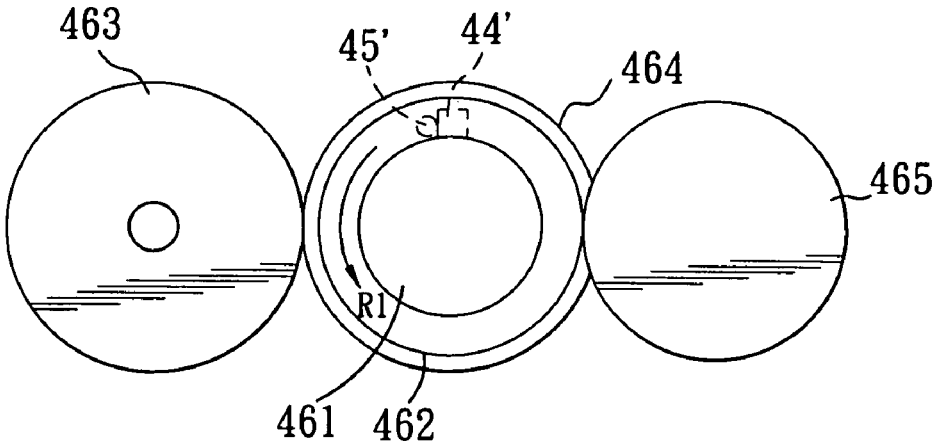

When the document sheet 400 is conveyed along the first conveying route 21, the second transmission member 462 of the transmission mechanism 46 is actuated by the power source 402 to rotate along with the driving component 45' of the roller module 4' in the second direction (R2) until the driving component 45' contacts a side of the driven component 44' of the roller module 4'. As shown in FIGS. 9, 12 and 13, during the movement of the document sheet 400 along the second conveying route 22, the second transmission member 462 is further actuated to rotate reversely along with the driving component 45' in the first direction (R1), such that the driving component 45' abuts against an opposite side of the driven component 44' and drives the driven component 44' to rotate in the first direction (R1) along with the first transmission member 461 of the transmission mechanism 46. Rotation of the first transmission member 461 is transferred to the transmission shaft 41' and the first roller 42' via the first and second gears 463, 464 of the transmission mechanism 46. Thus, the first roller 42' is rotated in the second direction (R2), thereby permitting feeding of the document sheet 400 through the nip 420'.

When the second transmission member 462 rotates in the first direction (R1), and before the driving component 45' abuts against the driven component 44', the first roller 42' does not rotate, thereby preventing the document sheet 400 from being fed through the nip 420'. Afterward, as conveying of the document sheet 400 is not interrupted, skew of the document sheet 400 can be corrected in the same manner as in the previous embodiment. Finally, as the first roller 42' is driven to rotate, the document sheet 400 is permitted to be fed through the nip 420'. The second preferred embodiment has the same advantages as those of the first preferred embodiment. In this embodiment, the first transmission member 461 is rotatable only in the first direction (R1)

Figure 14:
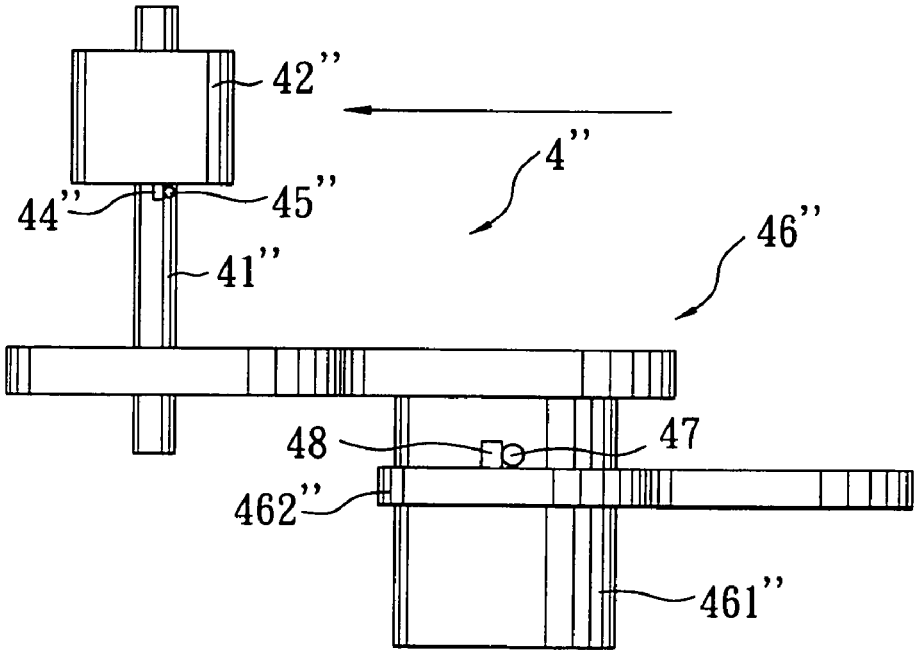
FIG. 14 is a schematic top view of a roller module and a transmission mechanism of a third preferred embodiment of the automatic document feeder according to the invention.

As shown in FIG. 14, the third preferred embodiment of the automatic document feeder according to the present invention includes a roller module 4" that has a structure similar to that of the first preferred embodiment, and a transmission mechanism 46" that has a structure similar to that of the second preferred embodiment. The roller module 4" includes a first roller 42", a transmission shaft 41" disposed rotatably in the first roller 41", a driven component 44" disposed fixedly on the first roller 42", and a driving component 45" disposed fixedly on the transmission shaft 41" for abutting against and driving the driven component 44" to rotate. The transmission mechanism 46" includes a first transmission member 461" that is rotatable to drive rotation of the transmission shaft 41" and that is provided with a driven member 47 disposed fixedly thereon, and a second transmission member 462" that is sleeved rotatably on the first transmission member 461", and that is provided with a driving member 48 disposed fixedly thereon for abutting against and driving the driven member 47 to rotate. In this embodiment, the roller module 4" operates in the same manner as that of the first preferred embodiment, and the transmission mechanism 46" operates in the same manner as that of the second preferred embodiment. Therefore, the document sheet 400 can be brought into contact with the roller module 4" for a longer time period than the first and second preferred embodiments to perform skew correction before the driving component 48 rotates the driven component 47. The third preferred embodiment has the same advantages as those of the first preferred embodiment.

Figure 15:
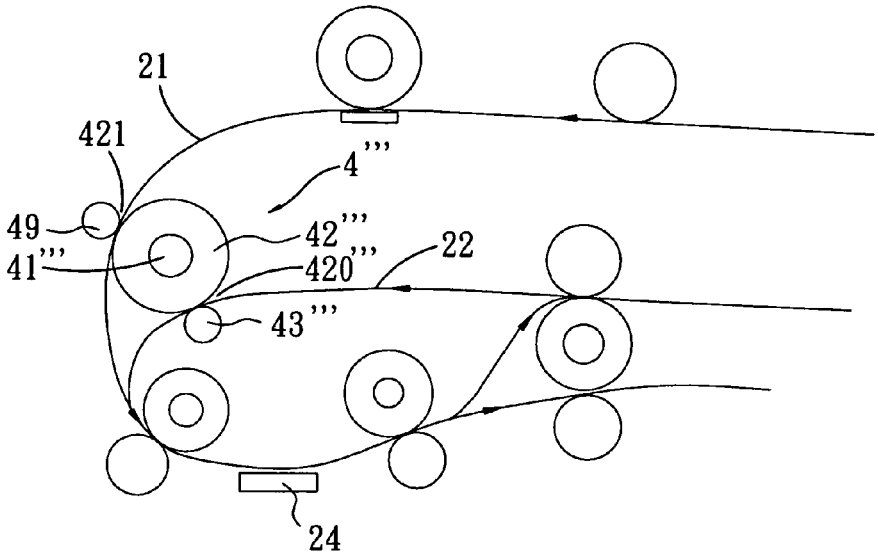
FIG. 15 is a schematic side view of a fourth preferred embodiment of the automatic document feeder according to the invention.

Referring to FIG. 15, the fourth preferred embodiment of the automatic document feeder according to the present invention has a structure similar to that of the first preferred embodiment. The main difference between this preferred embodiment and the first embodiment resides in the following. In this preferred embodiment, the automatic document feeder comprises a roller module 4'" having a first roller 42'", a transmission shaft 41'" that is disposed rotatably in the first roller 42'", a second roller 43'" that is disposed adjacent to and parallel to the first roller 42'" and that cooperates with the first roller 42'" to define a first nip 420'" disposed downstream of the image scanning unit 24, and a third roller 49 that is disposed adjacent to and parallel to the first roller 42'", that is spaced angularly apart from the second roller 43'", and that cooperates with the first roller 42'" to define a second nip 421 disposed upstream of the image scanning unit 24. With additional reference to FIG. 16, the roller module 4'" further has a driven component 44'" disposed fixedly on the first roller 42'", and a driving component 45'" disposed fixedly on the transmission shaft 41'".

Figure 16:
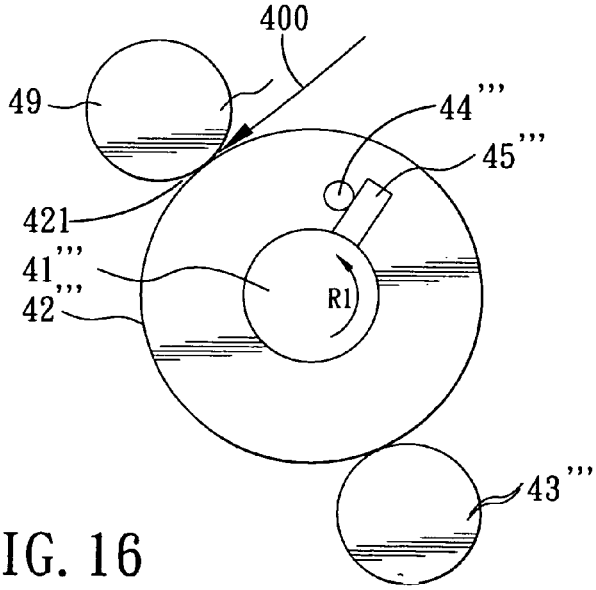
FIG. 16 is a schematic side view of a roller module of the fourth preferred embodiment, illustrating a document sheet being fed through a second nip.

Before the document sheet 400 is conveyed along the first conveying route 21, the transmission shaft 41'" is actuated to rotate in the second direction (R2) until the driving component 45'" contacts a side of the driven component 44'". Afterward, as shown in FIGS. 15 and 16, when the document sheet 400 is conveyed along the first conveying route 21, the transmission shaft 41'" is actuated to rotate reversely in the first direction (R1). During rotation of the transmission shaft 41'", and before the driving component 45'" abuts against the driven component 44'", the first roller 42'" does not rotate, and the document sheet 400 comes into contact with the first and third rollers 42'", 49 for a time period to perform skew correction in the same manner as the first preferred embodiment. Then, the driving component 45'" abuts against an opposite side of the driven component 44'" and drives the driven component 44'" to rotate in the first direction (R1), thereby driving the first roller 42'" to rotate in the first direction (R1) and permitting feeding of the document sheet 400 through the second nip 421.

Figure 17:
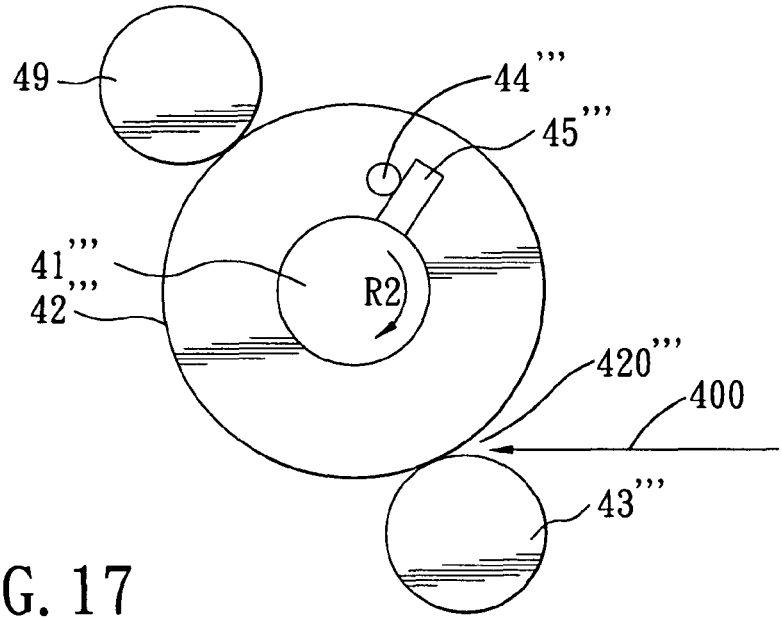
FIG. 17 is a view similar to FIG. 16, but illustrating the document sheet being fed through a first nip.

As shown in FIGS. 15 and 17, when the document sheet 400 is conveyed along the second conveying route 22, the transmission shaft 41'" is actuated once again to rotate in the second direction (R2). During rotation of the transmission shaft 41'" in the second direction (R2), and before the driving member 45'" abuts against the driven component 44'", the first roller 42'" does not rotate once again, so that the document sheet 400 comes into contact with the first and second rollers 42'", 43'" for a time period to perform skew correction. Finally, the driving component 45'" abuts against the driven component 44'" and drives the driven component 44'" to rotate in the second direction (R2), thereby driving the first roller 42'" to rotate in the second direction (R2) and permitting feeding of the document sheet 400 through the first nip 420'". Therefore, skew of the document sheet 400 can be corrected during movements of the document sheet 400 along the first and second conveying routes 21, 22. The fourth preferred embodiment has the same advantages as those of the first preferred embodiment.

Figure 18:
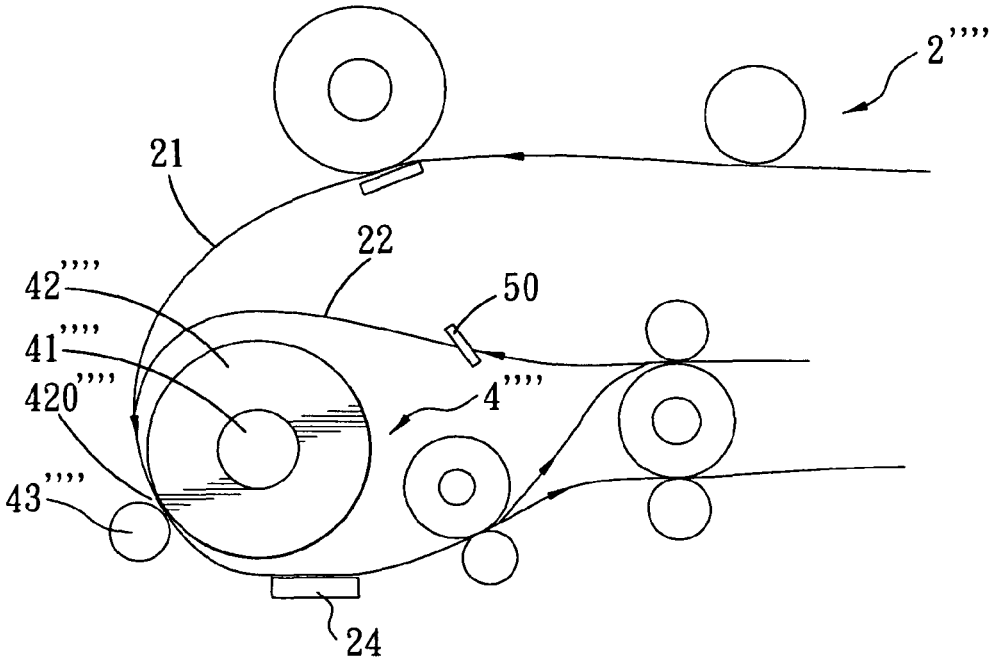
FIG. 18 is a schematic side view of a fifth preferred embodiment of, the automatic document feeder according of the invention.
Figure 19:
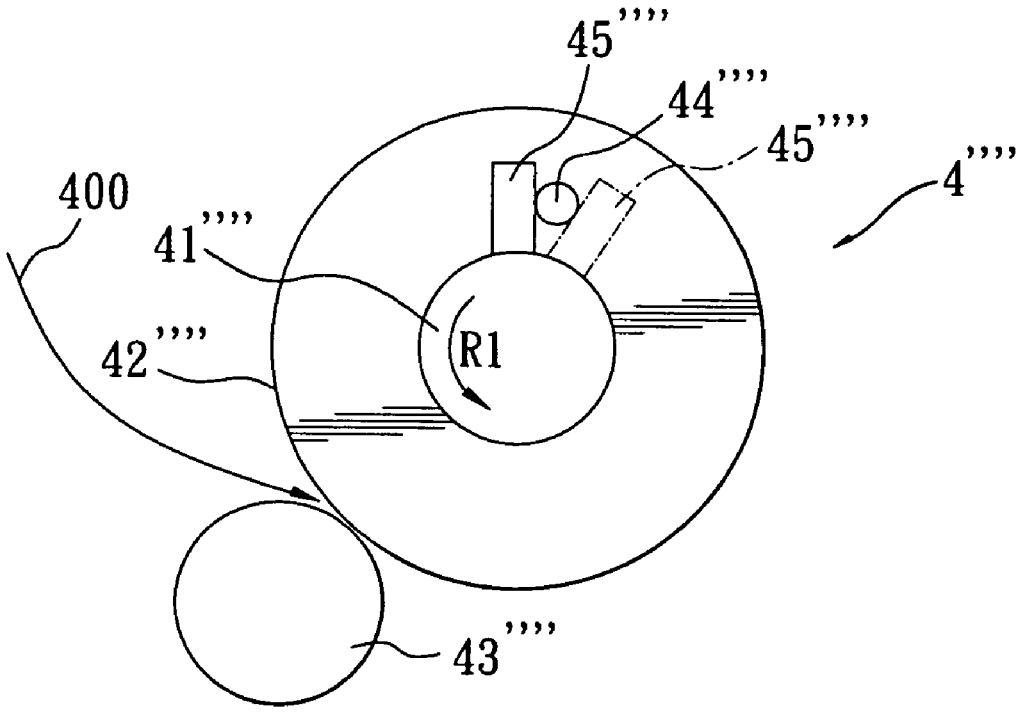
FIG. 19 is a schematic side view of a roller module of the fifth preferred embodiment.

Referring to FIGS. 18 and 19, the fifth preferred embodiment of the automatic document feeder 2"" according to the present invention has a structure similar to that of the first preferred embodiment. The main difference between this preferred embodiment and the first preferred embodiment resides in the following. In this embodiment, the automatic document feeder 2"" comprises a roller module 4"" including a first roller 42"", a transmission shaft 41"" that is disposed rotatably in the first roller 42"", a second roller 43"" that is disposed adjacent to and parallel to the first roller 42"" and that cooperates with the first roller 42"" to define a nip 420""

disposed upstream of the image scanning unit 24, a driven component 44"" disposed fixedly on the first roller 42"", and a driving component 45"" disposed fixedly on the transmission shaft 41"". The automatic document feeder 2"" further comprises a trigger unit 50 disposed downstream of the image scanning unit 24 for reversing the rotational direction of the transmission shaft 41"" when the document sheet 400 is fed therethrough. In this embodiment, the trigger unit 50 is a photointerrupter.

When the document sheet 400 is conveyed along the first conveying route 21, the transmission shaft 41"" is actuated to rotate in the first direction (R1) along with the driving component 45"". At that time, the first roller 42"" does not rotate, such that the document sheet 400 comes into contact with the first and second rollers 42"", 43"" for a time period to perform skew correction in the same manner as the first preferred embodiment. Then, the driving component 45"" abuts against a side of the driven component 44"" and drives the driven component 44"" to rotate in the first direction (R1) along with the first roller 42"", thereby driving the first roller 42"" to rotate in the first direction (R1) and permitting feeding of the document sheet 400 through the nip 420"".

When the document sheet 400 is conveyed toward the trigger unit 50 along the second conveying route 22, the transmission shaft 41"" keeps rotating in the first direction (R1). Afterward, once the leading edge of the document sheet 400 is conveyed through the trigger unit 50, the transmission shaft 41"" is actuated to rotate reversely. Once the trailing edge of the document sheet 400 is conveyed through the trigger unit 50, the transmission shaft 41 is actuated to rotate in the first direction (R1) once again. At that time, since the first roller 42"" does not rotate, the document sheet 400 comes into contact with the first and second rollers 42"", 43"" for a time period to perform skew correction once again in the same manner as the first preferred embodiment. The fifth preferred embodiment has the same advantages as those of the first preferred embodiment.

It should be further noted that, the transmission mechanism 46 included in the third preferred embodiment of the invention may be adopted in the fourth and fifth preferred embodiments of the invention for obtaining a longer time period for skew correction.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. An automatic document feeder adapted for feeding a document sheet, said automatic document feeder comprising:

an image scanning unit adapted for scanning the document sheet; and a roller module spaced apart from said image scanning unit and including a first roller, a second roller disposed adjacent to and parallel to said first roller, and cooperating with said first roller to define a first nip, a driven component disposed co-rotatable with said first roller, and a driving component rotatable for abutting against and driving said driven component to rotate, thereby permitting feeding of the document sheet through said first nip;

wherein, during rotation of said driving component, the document sheet is brought into contact with said first and second rollers for a predetermined time period before said driving component rotates said driven component;

said driven component of said roller module is disposed fixedly on said first roller of said roller module;

said first roller of said roller module has axially opposite first and second end surfaces and a shaft hole extending axially from said first end surface to said second end surface;

said roller module further includes a transmission shaft disposed rotatably in said shaft hole, said driving component being disposed fixedly on said transmission shaft;

said transmission shaft has an annular surrounding surface, and an end portion exposed from said first end surface of said first roller;

said driven component is a rod projecting axially from said first end surface of said first roller;

said driving component is a rod disposed fixedly on said end portion of said transmission shaft and projecting radially from said annular surrounding surface of said transmission shaft; and said transmission shaft is rotatable in a rotational direction to move said driving component from a side of said driven component to an opposite side of said driven component during the predetermined time period when the document sheet is in contact with said first and second rollers, and is further rotatable in the rotational direction such that said driving component abuts against and drives said driven component to rotate, thereby permitting feeding of the document sheet through said first nip.

2. The automatic document feeder as claimed in claim 1, wherein:

said first nip of said roller module is disposed upstream of said image scanning unit; and said automatic document feeder further comprises a trigger unit disposed downstream of said image scanning unit for reversing the rotational direction of said transmission shaft when the document sheet is fed therethrough.

3. The automatic document feeder as claimed in claim 2, wherein said trigger unit is a photointerrupter.

4. The automatic document feeder as claimed in claim 1, wherein said roller module is disposed downstream of said image scanning unit.

5. The automatic document feeder as claimed in claim 1, wherein:

said first nip of said roller module is disposed downstream of said image scanning unit; and said roller module further includes a third roller disposed adjacent to and parallel to said first roller, spaced angularly apart from said second roller, and cooperating with said first roller to define a second nip that is disposed upstream of said image scanning unit.

* * * * *